US009764171B2

(12) United States Patent
Ziaylek et al.

(10) Patent No.: US 9,764,171 B2
(45) Date of Patent: Sep. 19, 2017

(54) MOUNTING BRACKET FOR HOLDING A CYLINDRICAL TANK WITH A LOCKING MECHANISM RESPONSIVE TO LATERAL FORCE

(71) Applicant: Michael P. Ziaylek, Yardley, PA (US)

(72) Inventors: Michael P. Ziaylek, Yardley, PA (US); W. Brian McGinty, Huntington Valley, PA (US)

(73) Assignee: Michael P. Ziaylek, Yardley, PA (US)

( * ) Notice: Subject to any disclaimer, the term of this patent is extended or adjusted under 35 U.S.C. 154(b) by 0 days.

(21) Appl. No.: 14/921,754

(22) Filed: Oct. 23, 2015

(65) Prior Publication Data

US 2016/0144206 A1 May 26, 2016

Related U.S. Application Data

(60) Provisional application No. 62/122,542, filed on Oct. 23, 2014, provisional application No. 62/123,125, filed on Nov. 7, 2014.

(51) Int. Cl.
*F17C 13/12* (2006.01)
*A62B 25/00* (2006.01)

(52) U.S. Cl.
CPC ..... *A62B 25/00* (2013.01); *F17C 2205/0173* (2013.01); *F17C 2205/0188* (2013.01)

(58) Field of Classification Search
USPC ..... 248/311.2, 312, 312.1, 313; 224/148.4, 224/148.7, 251
See application file for complete search history.

(56) References Cited

U.S. PATENT DOCUMENTS

| | | | | |
|---|---|---|---|---|
| 1,328,271 | A * | 1/1920 | Dutemple | F16N 3/04 172/272 |
| 2,431,698 | A | 12/1947 | Lombard | |
| 2,615,238 | A | 10/1952 | Highwood | |
| 3,194,529 | A | 7/1965 | Brock | |
| 3,224,644 | A | 12/1965 | Davis | |
| 3,490,727 | A | 1/1970 | Miller | |
| 3,547,391 | A | 12/1970 | Johnson | |
| 3,565,384 | A | 2/1971 | Lockwood | |
| 3,603,550 | A | 9/1971 | Byrd | |
| D222,527 | S | 11/1971 | Ziaylek, Jr. | |

(Continued)

*Primary Examiner* — Alfred Wujciak
(74) *Attorney, Agent, or Firm* — Fox Rothschild LLP

(57) ABSTRACT

A mounting assembly for mounting a tank including a backing plate, a foot plate secured to a bottom portion of the backing plate and a clamping assembly secured to a top portion of the backing plate spaced from the foot plate such that a tank receiving zone is defined between the foot plate and the clamping assembly. The clamping assembly includes a bracket secured to the backing plate and a clamping member pivotally secured to the bracket and movable between a clamping position and a releasing position. The clamping assembly further includes a mechanical lock-out mechanism including a lock-out member moveable between an open position wherein the clamping member is free to pivot to the releasing position and a closed position wherein the lock-out member engages a portion of the clamping member and prevents pivoting thereof. The lock-out member is biased to the open position but moves to the closed position upon application of a high lateral force.

18 Claims, 8 Drawing Sheets

(56) References Cited

U.S. PATENT DOCUMENTS 3,667,714 A 6/1972 Ziaylek, Jr.
3,780,972 A 12/1973 Brodersen
3,791,403 A * 2/1974 Folkerth ..... F17C 13/084 128/204.18
3,823,907 A 7/1974 Ziaylek, Jr.
D237,357 S 10/1975 Ziaylek
3,971,591 A 7/1976 Ziaylek
D245,929 S 9/1977 Montambo
4,213,592 A * 7/1980 Lingenfelser ..... A62C 13/78 248/313
4,304,383 A 12/1981 Huston
D264,935 S 6/1982 Ziaylek, Jr.
D265,287 S 7/1982 Ziaylek, Jr.
D267,227 S 12/1982 Ziaylek, Jr.
4,379,541 A 4/1983 Harkness
4,434,961 A * 3/1984 Hoye ..... B60N 3/10 108/44
4,505,448 A 3/1985 Massie
4,586,687 A 5/1986 Ziaylek, Jr.
D298,704 S 11/1988 Ziaylek, Jr.
4,848,714 A 7/1989 Ziaylek, Jr. et al.
D303,738 S 10/1989 Ziaylek, Jr.
D314,325 S 2/1991 Ziaylek, Jr. et al.
D319,778 S 9/1991 Ziaylek, Jr.
5,213,392 A 5/1993 Bostrom et al.
5,314,233 A 5/1994 Bostrom et al.
D347,735 S 6/1994 Ziaylek, Jr. et al.
5,342,009 A * 8/1994 Lehner ..... A47G 23/0225 248/284.1
5,681,080 A 10/1997 Pond et al.
D390,367 S 2/1998 Demski et al.
D394,381 S 5/1998 Ziaylek, Jr. et al.
5,803,544 A 9/1998 Block et al.
5,934,749 A 8/1999 Pond et al.
6,702,242 B1 3/2004 Ziaylek, Jr. et al.
6,769,659 B1 8/2004 Martello
6,830,226 B2 12/2004 Field et al.
D562,116 S 2/2008 Ziaylek et al.
7,448,586 B2 11/2008 Ziaylek et al.
7,758,004 B2 * 7/2010 Brookman ..... A62B 25/00 248/154
D620,783 S 8/2010 Ziaylek
7,878,472 B2 2/2011 Lackore
7,922,246 B2 4/2011 Gale et al.
7,975,978 B2 7/2011 Ziaylek
8,220,764 B2 7/2012 Ziaylek
D729,142 S 5/2015 Ziaylek et al.
2009/0045657 A1 * 2/2009 Bostrom ..... A62B 9/04 297/188.04
2009/0250582 A1 * 10/2009 Ziaylek ..... A62B 25/00 248/312

* cited by examiner

MOUNTING BRACKET FOR HOLDING A CYLINDRICAL TANK WITH A LOCKING MECHANISM RESPONSIVE TO LATERAL FORCE

This application claims the benefit of U.S. Provisional Patent Application No. 62/122,542, filed on Oct. 23, 2014, and U.S. Provisional Application No. 62/123,125, filed on Nov. 7, 2014, the contents of each of which are incorporated herein by reference.

FIELD OF THE INVENTION

The present invention deals with brackets and other similarly constructed mounting devices utilized for detachably securing of cylindrical tanks such as emergency breathing apparatus tanks in position within emergency vehicles. It is important that such tank be fully and securely held therein but also be available for quick and easier removal by emergency personnel once the vehicle reaches the location of the fire or other emergency. Many devices have been designed for detachably securing such tanks including various clamping mechanisms and most are utilized for storing the cylindrical tank in an inverted position since this is the tank position when attached to the torso of an emergency worker. The present invention provides a unique means for minimizing extremely rapid or instantaneous movement of the bracket from the clamping position to the releasing position which would be experienced in an accident by the emergency vehicle or an unusually rapid movement. Such cylindrical tanks are quite heavy and the uncontrolled release of such a heavy piece of equipment during an accident or other rapidly decelerating incident could easily injure emergency personnel in the immediate area.

BACKGROUND OF THE INVENTION

Many prior art devices have been utilized for the purpose of retaining cylindrical tanks in an inverted position which are designed to hold them securely while allowing rapid release when needed. Examples of such construction are shown in U.S. Pat. No. 2,431,698 patented Dec. 2, 1947 to H. Lombard on a "Removable Mounting Installation" and U.S. Pat. No. 2,615,238 patented Oct. 28, 1952 to W. Highwood on a "Tank Clamp Support Holder"; and U.S. Pat. No. 3,194,529 patented Jul. 13, 1965 to G. R. Brock on a "Bracket For Holding Fire Extinguishers"; and U.S. Pat. No. 3,224,644 patented Dec. 21, 11965 to W. J. Davis on a "Dispenser"; and U.S. Pat. No. 3,490,727 patented Jan. 20, 1970 to H. Q. Miller on a "Holding Apparatus For Loads Adapted To Be Strapped To The Back Of Humans"; and U.S. Pat. No. 3,547,391 patented Dec. 15, 1970 to D. E. Johnson on a "Quick Release Support For Rescue Breathing Apparatus"; and U.S. Pat. No. 3,565,384 patented Feb. 23, 1971 to L. A. Lockwood and assigned to Bernzomatic Corporation on a "Bracket For Holding And Clamping Gas Cylinder Type Fire Extinguisher Tanks"; and U.S. Pat. No. 3,603,550 patented Sep. 7, 1973 to C. D. Byrd and assigned to Lacy J. Miller Machine Company, Inc. on a "Quick Release Support"; and U.S. Pat. No. 3,667,714 patented Jun. 6, 1972 to T. Ziaylek, Jr. on a "Tank Support"; and U.S. Pat. No. 3,780,972 patented Dec. 25, 1973 to J. C. Brodersen on a "Mounting Apparatus For Gas Containers"; and U.S. Pat. No. 3,823,907 patented Jul. 16, 1974 to T. Ziaylek, Jr. on a "Positive Locking Device"; and U.S. Pat. No. 3,971,591 patented Jul. 27, 1976 to J. Ziaylek and assigned to Ziamatic Corporation on a "Quic-Seat"; and U.S. Pat. No. 4,213,592 patented Jul. 22, 1980 to D. J. Lingenfelser and assigned to Caterpillar Tractor Co. on a "Bracket Assembly For Mounting Fire Extinguishers Thereon"; and U.S. Pat. No. 4,304,383 patented Dec. 8, 1981 to P. 0. Huston on a "Bracket For Holding A Tank"; and U.S. Pat. No. 4,379,541 patented Apr. 12, 1983 to D. M. Harkness on a "Holder For A Container"; and U.S. Pat. No. 4,505,448 patented Mar. 19, 1985 to C. P. Massie on a "Bracket For Fire Extinguishers"; and U.S. Pat. No. 4,586,687 patented May 6, 1986 to T. Ziaylek, Jr. on an "Air Tank Support Of The Quick Release Type"; and U.S. Pat. No. 4,848,714 patented Jul. 18, 1989 to T. Ziaylek, Jr. et al on a "Mounting Plate With Rollers"; and U.S. Pat. No. 5,213,392 patented May 25, 1993 to J. M. Bostrom et al on a "Seat Construction"; and U.S. Pat. No. 5,314,233 patented May 24, 1994 to J. M. Bostrom et al on a "Seat Construction Having A Mechanism For Storing A Tank"; and U.S. Pat. No. 5,681,080 patented Oct. 28, 1997 to G. M. Pond et al and assigned to Seats, Inc. on a "Vehicle Seat For Person Wearing Self-Contained Breathing Apparatus"; and U.S. Pat. No. 5,803,544 patented Sep. 8, 1998 to W. R. Block et al and assigned to H. O. Bostrom Company, Inc. on a "Seat Construction With Removable Side Cushions"; and U.S. Pat. No. 5,934,749 to G. M. Pond and assigned to Seats, Inc. on a "Vehicle Seat With Removable Bolsters And Pivoting Headrest Members"; and U.S. Pat. No. 6,702,242 patented Mar. 9, 2004 to T. Ziaylek, Jr. et al on a "Releasable Tank Holding Assembly Securable To A Hollow Seat Back To Facilitate Detachable Securement Of A Tank Thereinto"; and U.S. Pat. No. 6,769,659 patented Aug. 3, 2004 to G. A. Martello on a "Bottle Bracket"; and U.S. Pat. No. 6,830,226 patented Dec. 14, 2004 to B. J. Field et al and assigned to Pacific Safety Products Inc. on a "Quick Release Supporting Apparatus For A Canister"; and U.S. Pat. No. 7,975,978 patented Jul. 12, 2011 to M. P. Ziaylek on a "Positively Engaging Mounting Apparatus For Securely And Detachably Retaining Of A Cylindrical Tank"; and U.S. Design Pat. No. D222,527 patented Nov. 2, 1971 to T. Ziaylek, Jr. on a "Bracket For Use With Lifesaving Equipment"; and U.S. Design Pat. No. D237,357 patented Oct. 28, 1975 to T. Ziaylek, Jr. and assigned to Ziamatic Corporation on a "Tank Support Bracket For Lifesaving Equipment"; U.S. Design Pat. No. D245,929 patented Sep. 27, 1977 to R. J. Montambo and assigned to The Ansul Company on a "Fire Extinguishing Bracket"; and U.S. Design Pat. No. D264,935 patented Jun. 15, 1982 to T. Ziaylek, Jr. and assigned to Ziamatic Corporation on a "Combined Support And Display Bracket For A Self-Contained Breathing Apparatus"; and U.S. Design Pat. No. D265,287 patented Jul. 6, 1982 to T. Ziaylek, Jr. on a "Support Bracket For Biomarine Breathing Apparatus"; and U.S. Design Pat. No. D267,227 patented Dec. 14, 1982 to T. Ziaylek, Jr. and assigned to Ziamatic Corporation on a "Support Bracket For A Gas Cylinder"; and U.S. Design Pat. No. D298,704 patented Nov. 29, 1988 to T. Ziaylek, Jr. on a "Seat For Use Primarily In Emergency Vehicles"; and U.S. Design Pat. No. 1) 303,738 patented Oct. 3, 1989 to T. Ziaylek, Jr. on a "Rotatable Cylinder Holder"; and U.S. Design Pat. No. D314,325 patented Feb. 5, 1991 to T. Ziaylek, Jr. et al on a "Clamping Set Of Bracket Arms For Supporting Tubular Objects"; and U.S. Design Pat. No. D319,778 patented T. Ziaylek, Jr. on a "Vertical Support Brace Bracket Panel For Holding Tubular Objects"; and U.S. Design Pat. No. D347,735 patented Jun. 14, 1994 to T. Ziaylek, jr. et al on a "Quick Release Support Tank Bracket"; and U.S. Design Pat. No. 1) 390,367 patented Feb. 10, 1998 to R. F. Demski et al and assigned to Seats, Inc. and Pierce Manufacturing Inc. on a "Vehicle Seat"; and U.S.

Design Pat. No. D394,381 patented May 19, 1998 to T. Ziaylek, Jr. et al on a "Tank Bracket".

SUMMARY OF THE INVENTION

In at least one embodiment, the present invention provides a tank mounting assembly which facilitates quick release of a tank therefrom and allows the tank to be positioned in the tank holding zone by merely placing the head of the tank in contact with the base of the bracket and rotating the upwardly facing bottom portion of the tank into the holding zone.

In at least one embodiment, the present invention provides a tank mounting assembly for holding a cylindrical tank inverted which facilitates quick release and includes one or more assemblies for limiting rapid movement of the clamping member from the clamping position to the releasing position.

In at least one embodiment, the present invention provides a tank mounting assembly for holding a cylindrical tank in an inverted position which facilitates quick release thereof and yet firmly holds the tank in place to prevent injury to the wearer which could result from a motor vehicle accident of an emergency vehicle by limiting movement of the clamping member in the direction from the locking position to the unlocking position by the inclusion of a mechanical lock-out mechanism.

In at least one embodiment, the present invention provides a tank mounting assembly for positively engaging an inverted tank which facilitates providing quick access thereto and is particularly usable in securing an air tank to the rear portion of the seat in which persons, such as emergency workers, can be seated.

In at least one embodiment, the present invention provides a tank mounting assembly for positively engaging an inverted tank and facilitating quick release thereof which allows rapid manual release of the tank from the seat and the mounting assembly while preventing instantaneous release of the tank by the mounting assembly.

In at least one embodiment, the present invention provides a tank mounting assembly which engages the inverted tank securely and which also facilitates quick release thereof only in a safe and secure slower manner.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
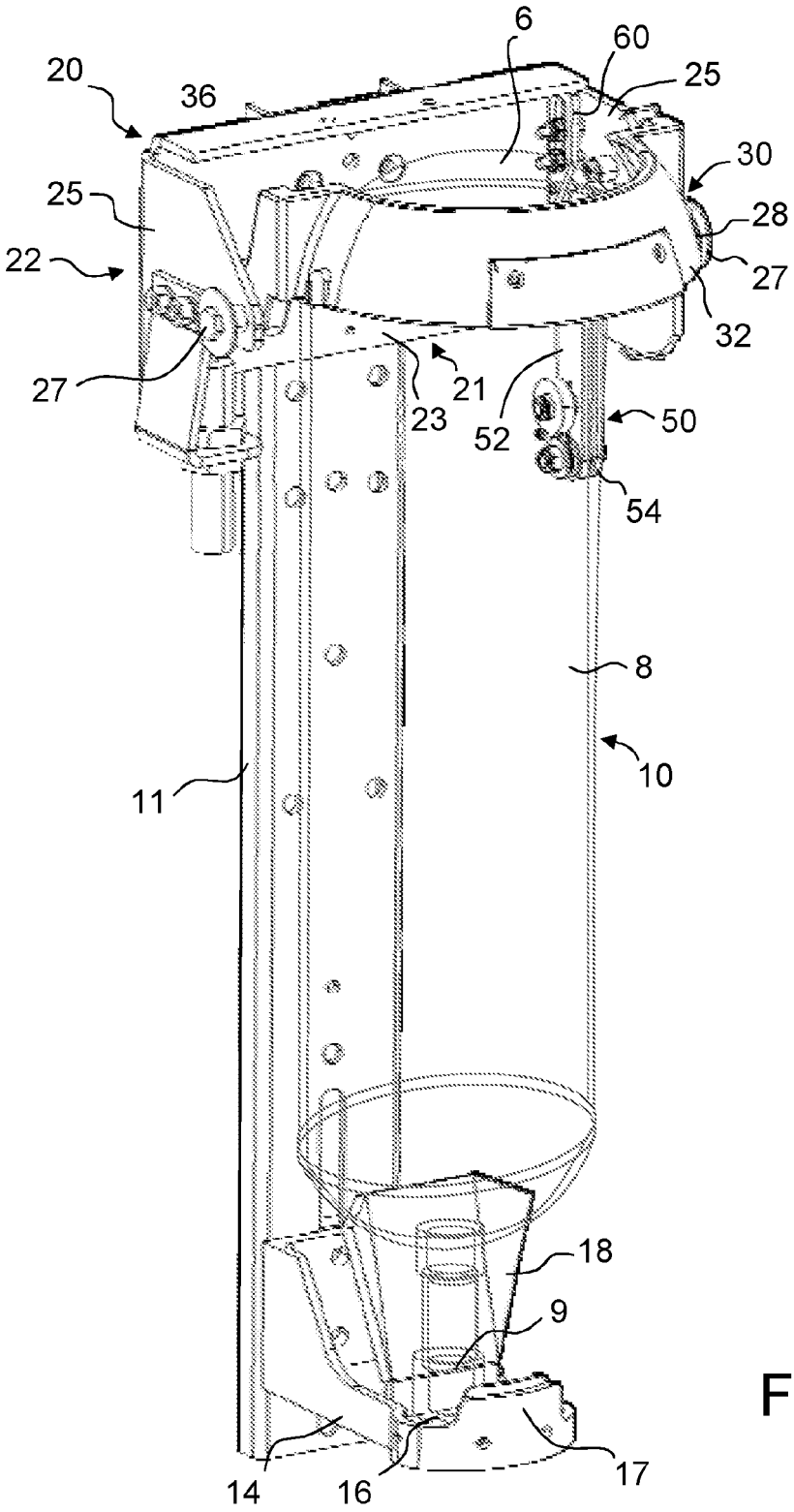
FIG. 1 is a perspective view of an exemplary mounting assembly in accordance with an embodiment of the present invention with a cylindrical tank illustrated therein in phantom.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
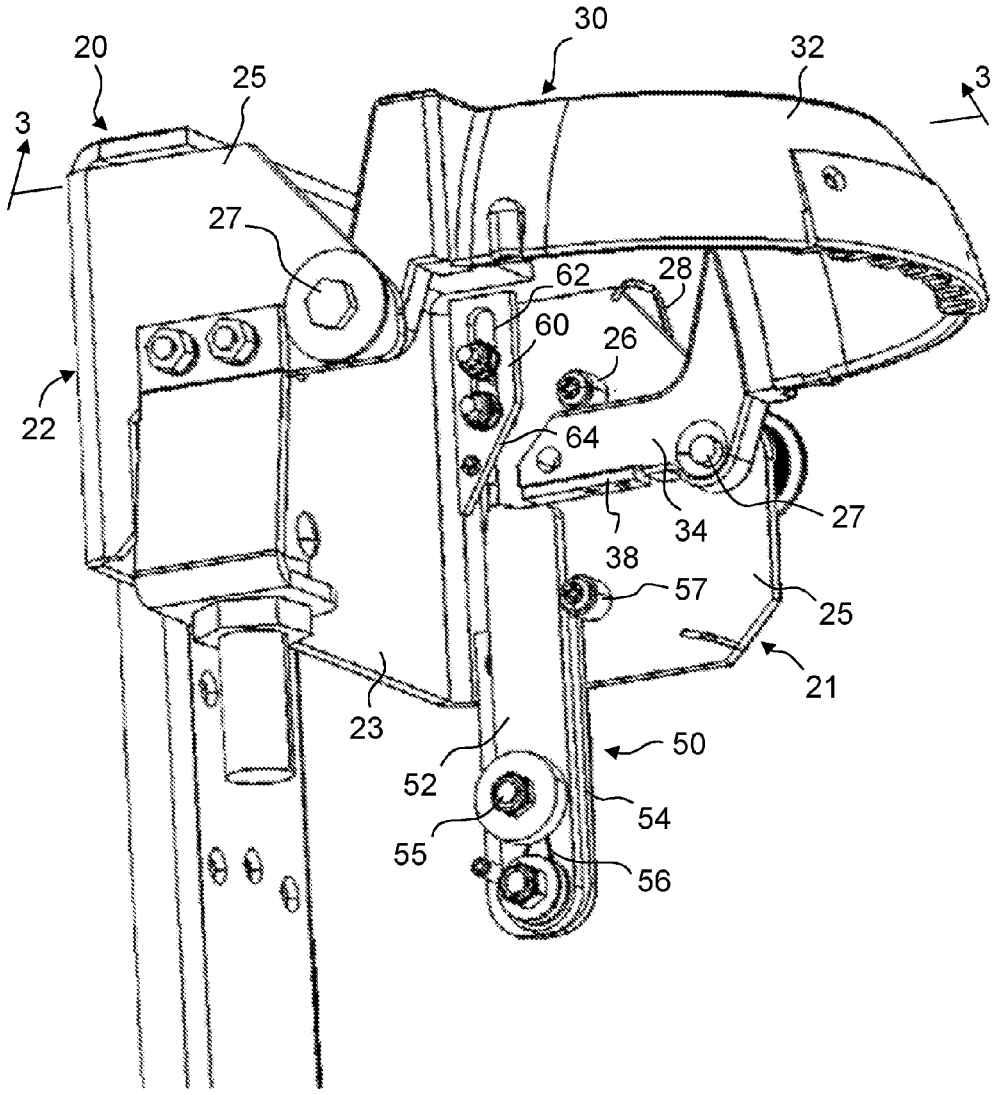
FIG. 2 is an expanded perspective view of the mounting assembly of FIG. 1 with the mounting bracket in a closed position.
Figure 3:
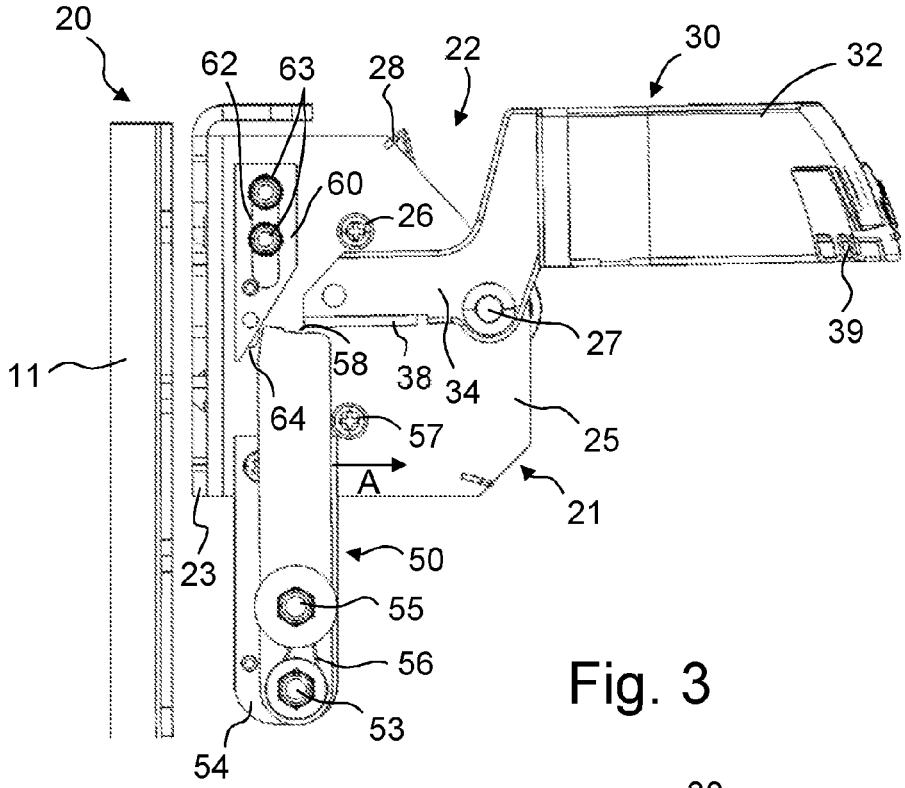
FIG. 3 is a cross-sectional view along the line 3-3 in FIG. 2 with the mounting bracket in a closed position.

Referring to FIGS. 1-3, an exemplary releasable mounting assembly 20 which securely retains a cylindrical tank 10 in an inverted position and includes a mechanical lock-out mechanism 50 for preventing release of a cylindrical tank 10 held therewithin responsive to exposure thereof to sudden laterally directed forces such as experienced during a vehicular accident. This apparatus is particularly designed to allow mounting of a cylindrical tank 10 with respect to the seatback assembly of otherwise conventional seating in vehicles such as fire trucks or other emergency vehicles which require ready availability of cylindrical tanks 10 such as for supplying oxygen to firemen or other emergency workers.

The mounting assembly 20 includes a backing plate 11 which is generally a vertically extending member and which can be easily attached to a seatback or any other environmental structure within an emergency or other vehicle for the purpose of facilitating mounting of the cylindrical tank 10 therewithin. The backing plate 11 often define a plurality of apertures extending therethrough to facilitate securement with threaded fasteners such as screws or bolts with respect to environmental structure.

A foot member or foot plate 14 is secured to the bottom portion of the backing plate 11 and is adapted to support the tank head 9 of cylindrical tank 10 in an inverted position. Foot plate 14 is, preferably, defined in the shape of a foot cup 16 facing upwardly to facilitate receiving of the cylindrical tank head 9 therewithin. Guiding of movement of the cylindrical tank head 9 into the foot cup 16 is achieved by the positioning of a foot guiding plate 18 at an intermediate location within the foot cup 16 and spatially disposed from the backing plate 11. The foot cup 16 preferably includes a foot front stop 17 which is spaced from the foot guiding plate 18 by a distance approximately equal to the size of the cylindrical tank head 9. In this manner, as the tank 10 is moved into the tank receiving zone 16, the cylindrical tank head 9 comes into abutment with the foot guiding plate 18. As the tank 10 moves into the tank receiving zone 16, the foot guiding plate 18 guides the tank head 9 into the location between the foot guiding plate 18 and the front foot stop 17 of foot cup 16 due to the inclined orientation of the outer facing surface of the foot guiding plate 18. This apparatus significantly facilitates the repeated placement of a cylindrical tank head 9 in abutment with the present mounting assembly 20 when securing a cylindrical tank 10 oriented in an inverted position within the tank receiving zone 16.

A clamping assembly 22 extends from the backing plate 11 at a position significantly higher or above the location of the foot plate 14. In this manner, a tank receiving zone 16 extends longitudinally vertically along the vertically extending backing plate 11 between the clamping assembly 22 and the foot plate 14 therebelow. This tank receiving zone 16 as so defined facilitates the mounting of the cylindrical tank 10 in an inverted orientation with the cylinder tank head 9 positioned in abutment with the foot plate 14 and with the body portion 8 of the tank 10 extending upwardly along the backing plate 11, and generally parallel with respect thereto, to a location wherein positioning of a clamping member 30 of the clamping assembly 22 in a clamping position facilitates maintaining of the tank 10 in the inverted orientation. As described in more detail hereinafter, the clamping member 30 is movable between the clamping position illustrated in FIGS. 1 and 2 and a releasing position as illustrated in FIG. 3 which allows removal of tank 10 from the mounting assembly 20 by removal thereof from the tank receiving zone 16.

The clamping assembly 22, preferably, is mounted with respect to the backing plate 11 in an orientation extending general perpendicularly outwardly therefrom. The clamping assembly 22 includes a bracket 21 having a back plate 23 with opposed side plates 25 extending therefrom. Preferably, the back plate 23 extends generally parallel with respect to the plane of the backing plate 11 at a location thereabove and the side plates 25 extend outwardly from the back plate 23. With this configuration, the bracket 21 has a generally C-shaped configuration which receives the body portion 8 of cylindrical tank 10 therein.

The clamping member 30 also has a generally C-shaped configuration with an arcuate central portion 32 extending between opposed arms 34 and 36. Each arm 34, 36 is pivotally attached to a respective side plate 25 via a pivot pin 27. The clamping member 30 is pivotally movable between the clamping position and the releasing position. In the clamping position, the cylindrical tank 10, including the tank head 9 and the tank body 8, are fixedly secured within the tank receiving zone 16. Movement of the clamping member 30 toward the releasing position releases the body 8 and head 9 of the cylindrical tank 10 from the tank receiving zone 16 and allows it to be released from the bracket assembly and utilized normally at the location of an emergency situation where emergency personnel would often need a portable supply of oxygen.

A return biasing means 28, illustrated as a flexibly resilient wire coil spring, is wound about one of the pivot pins 27 and is secured at both ends relative to the bracket 21. The wire coil spring engages the pivot pin 27 and biases the pivot pin 27, and thereby the clamping member 30, toward the clamping position with a moderate continuously exerted force. While a wire coil spring engaged with the pivot pin 27 is illustrated, other biasing assemblies may be utilized, for example, a coil spring extending between the bracket 31 and the clamping member 30. A stop 26 is positioned extending through one of the side plates 35 and engages the respective arm 34 and prevents over rotation of the clamping member 30.

Movement of the clamping member 30 from the clamping position to the releasing position to facilitate release of the tank 10 from the mounting assembly 20 is most commonly achieved by manually overpowering the force exerted by the return biasing means 28 by lifting the front portion of the clamping member 30 and causing it to pivot toward the releasing position. Preferably, the clamping member 30 is also configured to allow for automatic movement of clamping member 30 to the releasing position when the wearer of the tank 10 gets up from the seat they are in. To facilitate such, the clamping member 30 has an internal slope 39 (see FIG. 3) which engages a rounded portion 6 of the tank body 8, whereby pulling of the tank 10 away from the backing plate 11 pushes on the sloped surface 39 and moves the clamping member 30 to the releasing position.

While it is convenient for the mounting assembly 20 to easily release the tank 10 when the wearer intentionally exits the seat, the mounting assembly 20 is configured such that the tank 10 not be released do to an unintended lateral force, for example, an inertia force caused by a sudden, sharp change of speed of the vehicle. To achieve such, the mounting assembly 20 of the present embodiment includes a mechanical lock-out mechanism 50 which engages a portion of the clamping mechanism 30 and prevents pivoting thereof in response to a sudden high force.

Figure 4:
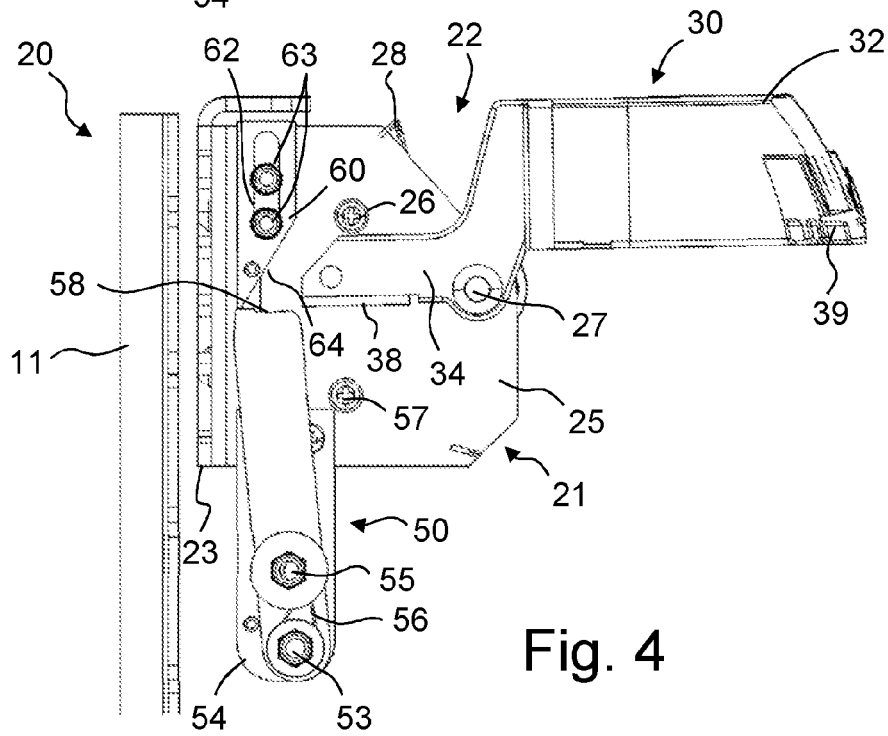
FIG. 4 is a cross-sectional view similar to FIG. 3 with a lock-out mechanism of the mounting bracket in an open position.
Figure 5:
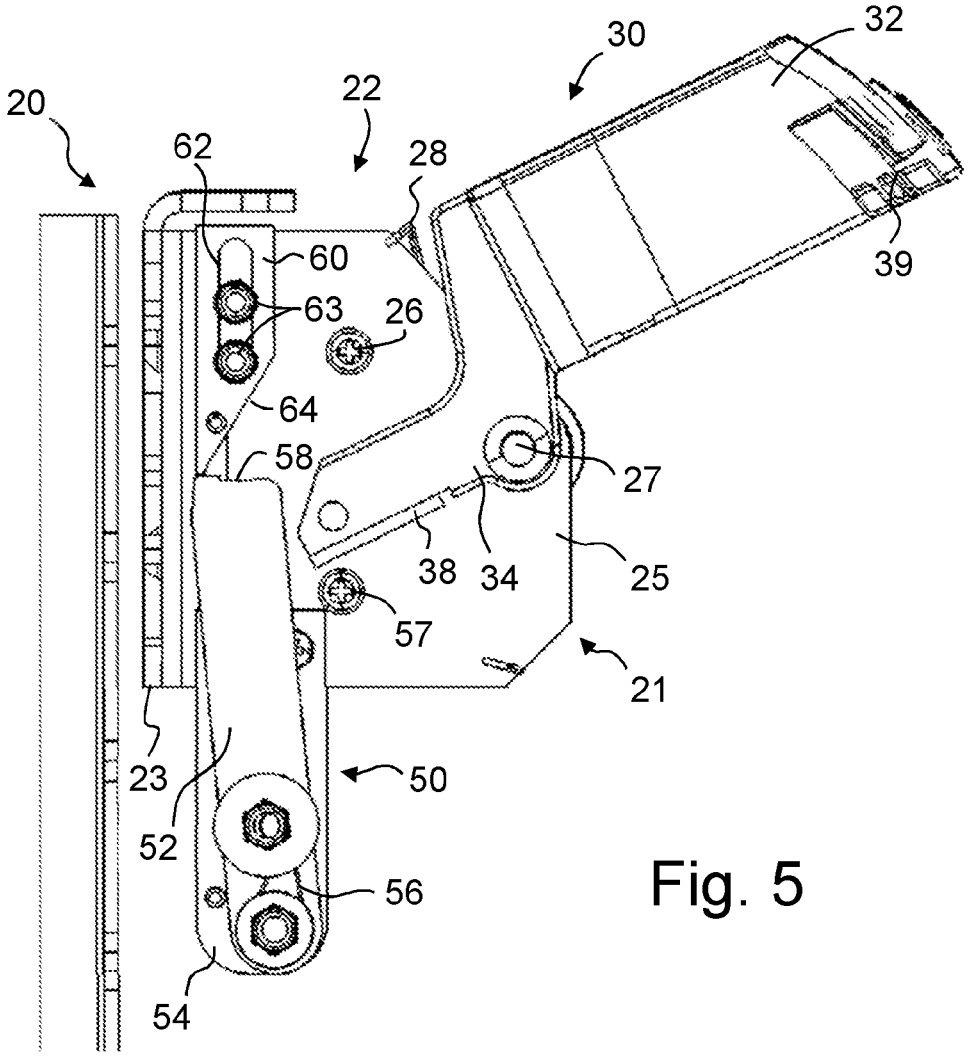
FIG. 5 is a cross-sectional view similar to FIG. 3 with a clamping member of the mounting bracket in a releasing position.
Figure 6:
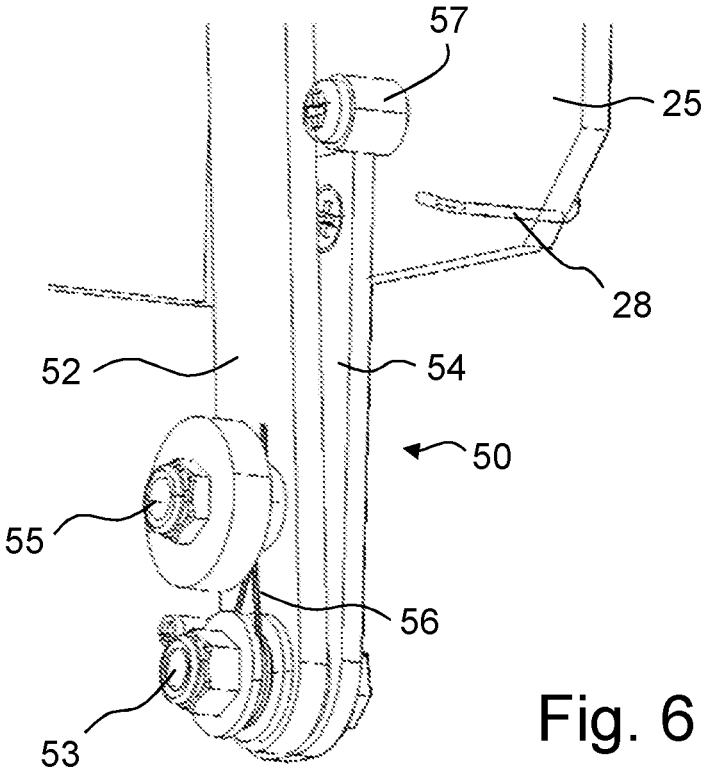
FIG. 6 is an expanded view of the lock-out mechanism of the mounting bracket of FIG. 1.

The exemplary mechanical lock-out mechanism 50 of the present embodiment is a pivoting mechanical lock-out mechanism. The pivoting mechanical lock-out mechanism 50 is responsive to sensing large magnitude forces which are normally directed laterally toward the front of a vehicle during rapid vehicle deceleration to prevent movement of the clamping member 30 to the releasing position which would allow unlocking of the tank 10 from the mounting assembly 20. The pivoting mechanical lock-out mechanism 50 is movable between a pivoting lock-out closed position as illustrated in FIGS. 2 and 3 and a pivoting lock-out opened position as illustrated in FIGS. 4 and 5. When the pivoting lock-out mechanism 50 is in the closed position, movement of the clamping member 30 toward the releasing position is blocked or otherwise prevented. In the pivoting lock-out opened position, movement of the clamping member 30 toward the releasing position is facilitated or otherwise allowed.

To achieve the mechanical locking, the pivoting mechanical lock-out mechanism 50 preferably includes a pivoting lock-out bar 52 pivotally movably secured with respect to bracket 21, such as, by being pivotally secured at pivot pin 53 to an extension member 54 which is secured with respect to one of the side plates 25. The free end of the lock-out bar 52 defines a blocking shoulder 58 configured to engage a contact plate 38 on the arm 34 of the clamping member 30 when the lock-out bar 52 is in the pivoting lock-out closed positioned, as illustrated in FIG. 3.

A spring 56 or similar biasing member is positioned between the pivot pin 53 and a connector 55 on the lock-out bar 52 and biases the lock-out bar 52 toward the pivoting lock-out opened position as illustrated in FIG. 4. The spring 56 may be, for example, a wound wire spring or a flat spring. With the lock-out bar 52 in the pivoting lock-out open position, the clamping member 30 is free to be pivoted against the bias of the return biasing means 28 to the releasing position as illustrated in FIG. 5.

The pivoting mechanical lock-out bar 52 is responsive to extremely rapid or instantaneous deceleration of the vehicle within which the mounting bracket 20 is secured to move instantly to the pivoting lock-out closed position. That is, upon a sudden deceleration, a force will be applied to the lock-out bar 52 in the direction of arrow A in FIG. 3. The bar 52 pivots about the pivot pin 53 and moves the short distance necessary such that the blocking shoulder 58 aligns with the contact plate 38 and prevents pivoting of the clamping member 30. A stop member 57 extends from the side plate 35 to limit the range of pivoting.

To maintain the lock-out bar 52 in the pivoting lock-out closed position, a slidable wedge 60 is supported on the side plate 25. The wedge 60 includes a slot 62 into which studs 62 extending from the side plate 25 are positioned such that the wedge 60 is able to move vertically over the range of the slot 62. The wedge 60 has an inclined face 64 which is directed toward the lock-out bar 52. When the lock-out bar 52 is biased toward the pivoting lock-out open position, a portion of the bar 52 is below a tip of the wedge 60 and the wedge 60 is maintained in an upper position as illustrated in FIG. 4. The inclined face 64 insures that the wedge 60 does not interfere with the movement of the lock-out bar 52 to the pivoting lock-out closed position.

As explained above, upon a sudden deceleration of the emergency vehicle responsive to a vehicle accident or the like, and an instantaneous force is exerted on the pivoting lock-out bar 52 and it moves instantaneously to the pivoting lock-out closed position. With the lock-out bar 52 in this closed position, movement of clamping member 30 toward the releasing position is prevented. After the event, it is also important that the lock-out bar 52 be incapable of backing out of the pivoting lock-out closed position until it is manually reset after the event has terminated. Prevention of such movement of the bar 52 is achieved because when it initially moves to the pivoting lockout closed position, the slidable wedge 60, almost simultaneously, moves downwardly to a position immediately behind the lock-out bar 52 as illustrated in FIG. 2. This downwardly directed movement of the slidable wedge 60 is facilitated because of the ease of vertical movement achieved by the large dimensional clearance surrounding the first studs 63 in their position extending through the slot 62. That is, the slidable wedge 60 is free to move downwardly due to gravitational force responsive to movement of the lock-out bar 52 to the pivoting lock-out closed position.

Figure 7:
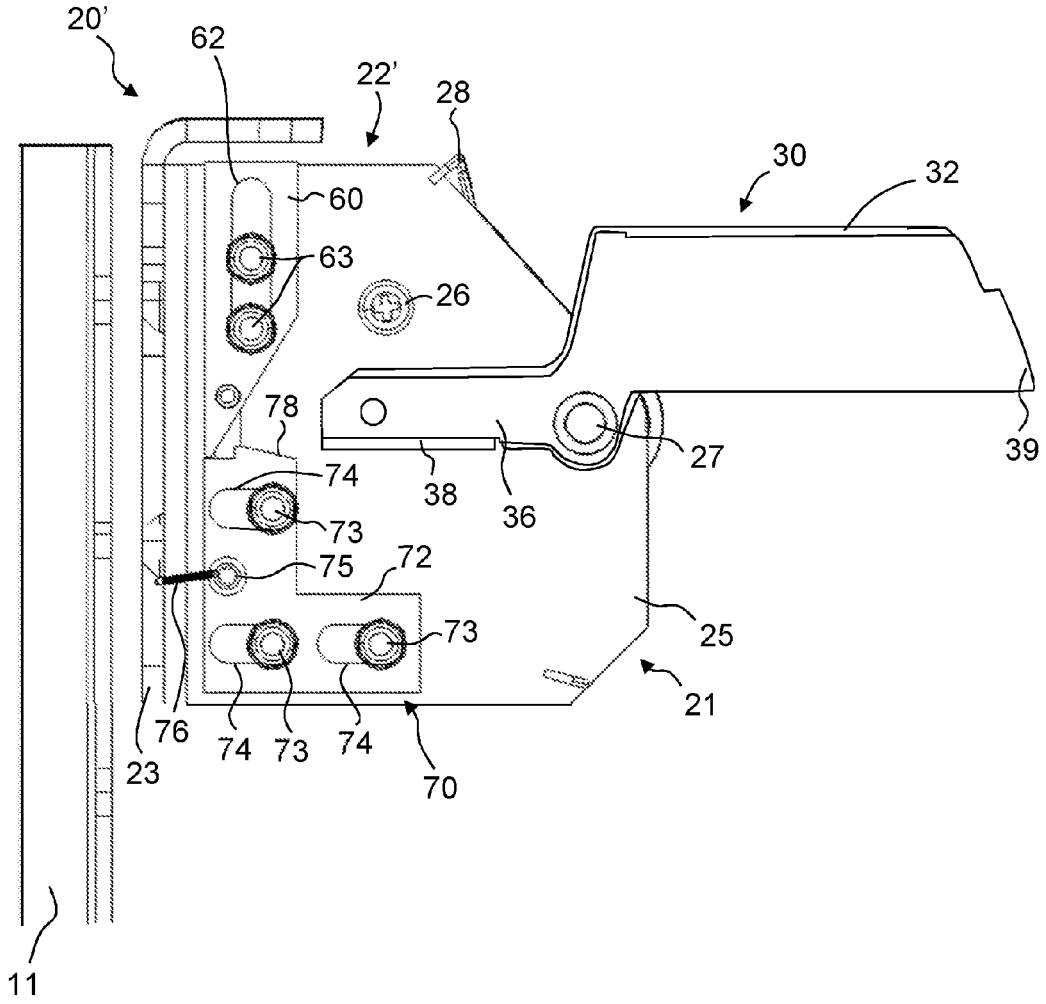
FIG. 7 is a cross-sectional view similar to FIG. 3 showing an alternative lock-out mechanism in accordance with an embodiment of the invention in open position.
Figure 8:
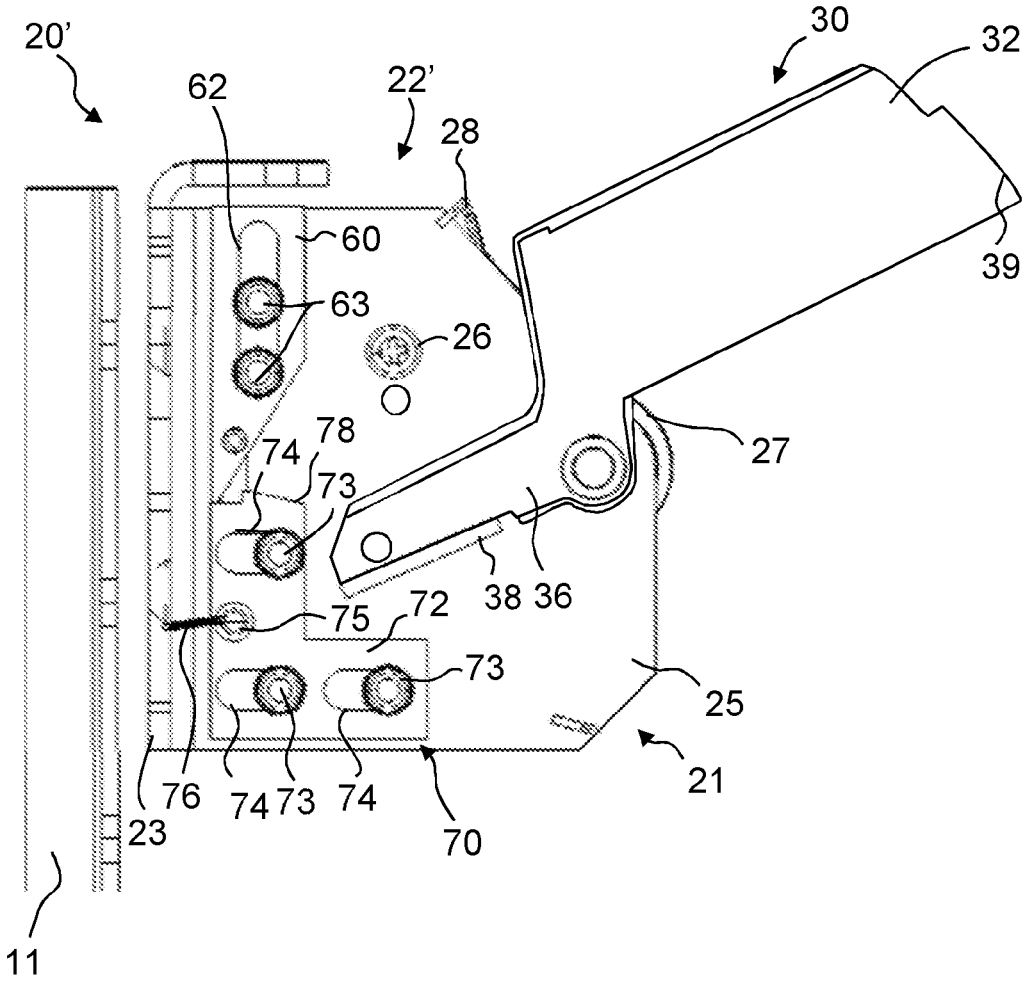
FIG. 8 is a cross-sectional view similar to FIG. 7 showing the alternative lock-out mechanism in an open position with the clamping member pivoted.
Figure 9:
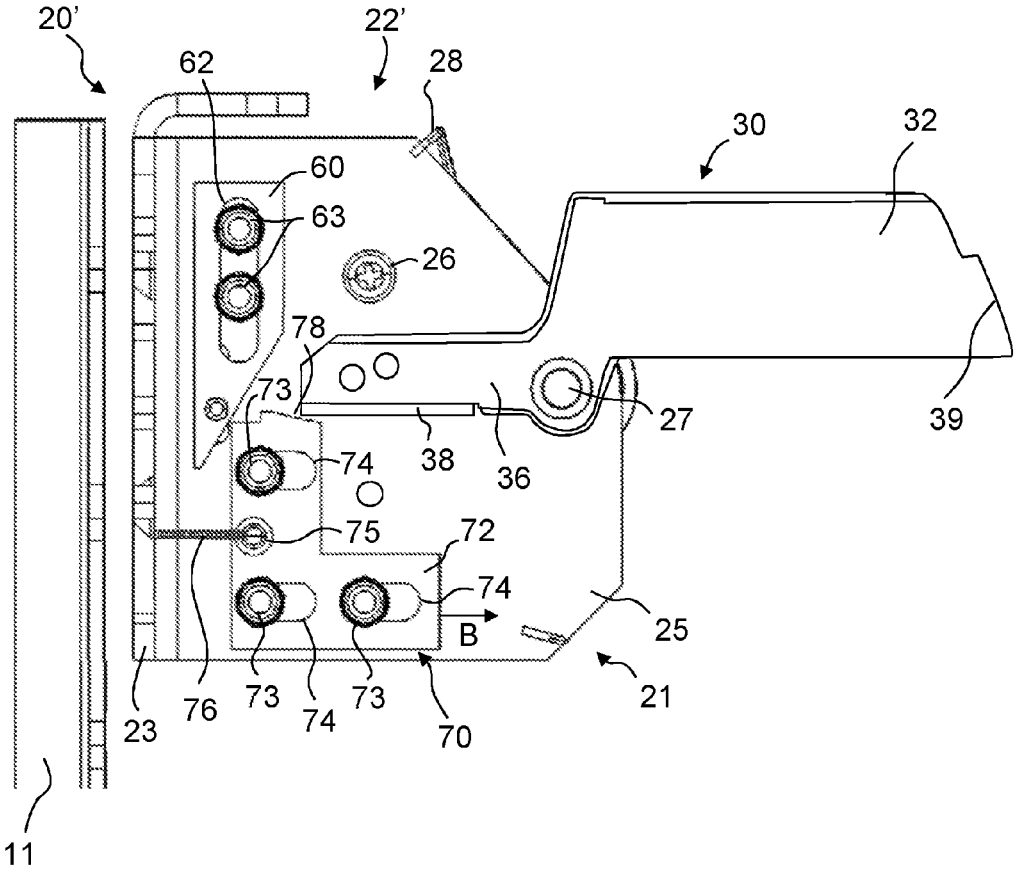
FIG. 9 is a cross-sectional view similar to FIG. 7 showing the alternative lock-out mechanism in a closed position preventing pivoting of the clamping member.

Referring to FIGS. 7-9, a mounting assembly 20' in accordance with another embodiment of the invention be described. The mounting assembly 20' is similar to the previous embodiment and includes a clamping assembly 22' with a bracket 21 secured to the backing plate 11. The backing plate 11 includes a foot plate (not shown) similar to the previous embodiment. A clamping member 30 is pivotally secured relative to the bracket 21 and an alternative mechanical lock-out mechanism 70 which engages the contact plate 38 of one arm 34 of the clamping mechanism. The features common to both embodiments operate as previously described and are not be described again.

The mechanical lock-out mechanism 70 of the present embodiment includes an L-shaped lock-out plate 72. The lock-out plate 72 is mounted to one of the side plates 25 via a plurality of studs 73 extending through respective slots 74 defined through the plate 72. The slots 74 extend from back to front such that the plate 72 is slidable from back to front. An upper portion of the plate 72 defines a blocking shoulder 78 which prevents rotation of the clamping member 30 when positioned in the lock-out closed position illustrated in FIG. 9.

A spring 76 or the like extends from the back plate 23 of the bracket 21 to a connector 75 on the lock-out plate 72. The spring 76 biases the lock-out plate 72 toward the lock-out opened position as illustrated in FIG. 7. With the lock-out plate 72 in the lock-out open position, the clamping member 30 is free to be pivoted against the bias of the return biasing means 28 to the releasing position as illustrated in FIG. 8.

The mechanical lock-out plate 72 is responsive to extremely rapid or instantaneous deceleration of the vehicle within which the mounting bracket 20' is secured to move instantly to the lock-out closed position. That is, upon a sudden deceleration, a force will be applied to the lock-out plate 72 in the direction of arrow B in FIG. 9. The plate 72 slides relative the studs 73 and moves the short distance necessary such that the blocking shoulder 78 aligns with the contact plate 38 and prevents pivoting of the clamping member 30. The slots 74 limit the range of sliding of the lock-out plate 72. As in the previous embodiment, a slidable wedge 60 may be provided on the side plate 25 to prevent the lock-out plate 72 from backing out of engagement. These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A mounting assembly for mounting a tank, the mounting assembly comprising:
- a backing plate;
- a foot plate secured to a bottom portion of the backing plate; and
- a clamping assembly secured to a top portion of the backing plate spaced from the foot plate such that a tank receiving zone is defined between the foot plate and the clamping assembly, the clamping assembly comprising:
  - a bracket secured to the backing plate and a clamping member pivotally secured to the bracket and movable between a clamping position and a releasing position; and
  - a mechanical lock-out mechanism including a lock-out member moveable between an open position wherein the clamping member is free to pivot to the releasing position and a closed position, wherein the clamping member is in the clamping position, wherein the lock-out member engages a portion of the clamping member and prevents pivoting thereof, wherein the lock-out member is biased to the open position but moves to the closed position upon application of a high lateral force, and further wherein the lock-out member includes a bar pivotally connected relative to the bracket at a first end and a second opposite end defines a blocking shoulder configured to engage a contact plate of the clamping member in the closed position.

2. The mounting assembly of claim 1, wherein an extension member extends from the bracket and the bar is pivotally connected to the extension member.

3. The mounting assembly of claim 2 wherein a spring extends between the extension member and the bar to bias the bar to the open position.

4. The mounting assembly of claim 1 wherein the lock-out member includes a plate supported on the bracket for lateral movement relative thereto.

5. The mounting assembly of claim 4 wherein a plurality of studs extend from the bracket with each stud received in respective slot through the plate and the interaction between the studs and the slots define the range of lateral motion of the plate.

6. The mounting assembly of claim 5 wherein a portion of the plate defines a blocking shoulder configured to engage a contact plate of the clamping member in the closed position.

7. The mounting assembly of claim 6 wherein the plate is L-shaped and an upper portion of the plate defines the blocking shoulder.

8. The mounting assembly of claim 4 wherein a spring extends between the bracket and the plate to bias the plate to the open position.

9. The mounting assembly of claim 1 further comprising a wedge member slidably secured to the bracket, the wedge member configured, upon movement of the lock-out member to the closed position, to slide into a position which blocks the lock-out member from returning to the open position.

10. A mounting assembly for mounting a tank, the mounting assembly comprising:

a backing plate;

a foot plate secured to a bottom portion of the backing plate;

a clamping assembly secured to a top portion of the backing plate spaced from the foot plate such that a tank receiving zone is defined between the foot plate and the clamping assembly, the clamping assembly comprising:

a bracket secured to the backing plate and a clamping member pivotally secured to the bracket and movable between a clamping position and a releasing position; and a mechanical lock-out mechanism including a lock-out member moveable between an open position wherein the clamping member is free to pivot to the releasing position and a closed position, wherein the clamping member is in the clamping position, wherein the lock-out member engages a portion of the clamping member and prevents pivoting thereof, wherein the lock-out member is biased to the open position but moves to the closed position upon application of a high lateral force; and a wedge member slidably secured to the bracket, the wedge member configured, upon movement of the lock-out member to the closed position, to slide into a position which blocks the lock-out member from returning to the open position to prevent the clamping member from pivoting.

11. The mounting assembly of claim 10, wherein the lock-out member includes a bar pivotally connected relative to the bracket at a first end and a second opposite end defines a blocking shoulder configured to engage a contact plate of the clamping member in the closed position.

12. The mounting assembly of claim 11, wherein an extension member extends from the bracket and the bar is pivotally connected to the extension member.

13. The mounting assembly of claim 12, wherein a spring extends between the extension member and the bar to bias the bar to the open position.

14. The mounting assembly of claim 10, wherein the lock-out member includes a plate supported on the bracket for lateral movement relative thereto.

15. The mounting assembly of claim 14, wherein a plurality of studs extend from the bracket with each stud received in respective slot through the plate and the interaction between the studs and the slots define the range of lateral motion of the plate.

16. The mounting assembly of claim 15, wherein a portion of the plate defines a blocking shoulder configured to engage a contact plate of the clamping member in the closed position.

17. The mounting assembly of claim 16, wherein the plate is L-shaped and an upper portion of the plate defines the blocking shoulder.

18. The mounting assembly of claim 14, wherein a spring extends between the bracket and the plate to bias the plate to the open position.

* * * * *